US009650705B2

(12) United States Patent
Schaeffer et al.

(10) Patent No.: US 9,650,705 B2
(45) Date of Patent: May 16, 2017

(54) TITANIUM ALUMINIDE APPLICATION PROCESS AND ARTICLE WITH TITANIUM ALUMINIDE SURFACE

(71) Applicant: GENERAL ELECTRIC COMPANY, Schenectady, NY (US)

(72) Inventors: Jon Conrad Schaeffer, Simpsonville, SC (US); Krishnamurthy Anand, Karnataka (IN); Sundar Amancherla, Karnataka (IN); Eklayva Calla, Karnataka (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1120 days.

(21) Appl. No.: 13/896,434

(22) Filed: May 17, 2013

(65) Prior Publication Data

US 2016/0145728 A1 May 26, 2016

Related U.S. Application Data

(62) Division of application No. 13/276,568, filed on Oct. 19, 2011, now Pat. No. 8,475,882.

(51) Int. Cl.

| | |
|---|---|
| ***C22F 1/04*** | (2006.01) |
| ***C22C 14/00*** | (2006.01) |
| ***C23C 24/04*** | (2006.01) |
| ***F01D 5/00*** | (2006.01) |
| ***F01D 25/00*** | (2006.01) |

(Continued)

(52) U.S. Cl.

CPC ..... *C22F 1/04* (2013.01); *B22F 1/0003* (2013.01); *C21D 7/06* (2013.01); *C21D 9/0068* (2013.01); *C22C 14/00* (2013.01); *C22C 21/00* (2013.01); *C23C 24/04* (2013.01); *F01D 5/005* (2013.01);

(Continued)

(58) Field of Classification Search

CPC ..... C22C 14/00; C22C 21/00; C22F 1/183; C22F 1/04; C23C 24/04; B22F 1/0003

See application file for complete search history.

(56) References Cited

U.S. PATENT DOCUMENTS 5,028,277 A * 7/1991 Mizoguchi et al. ..... 428/660
5,768,679 A * 6/1998 Taguchi et al. ..... 428/548

(Continued)

FOREIGN PATENT DOCUMENTS

EP 2072634 A2 6/2009
EP 2333134 A1 6/2011

(Continued)

OTHER PUBLICATIONS

Yamaguchi, M., et al. "Gamma titanium aluminide alloys." MRS Proceedings. vol. 364. Cambridge University Press, 1994.*

(Continued)

*Primary Examiner* — Jessee Roe

(74) *Attorney, Agent, or Firm* — McNees Wallace & Nurick, LLC

(57) ABSTRACT

A titanium aluminide application process and article with a titanium aluminide surface are disclosed. The process includes cold spraying titanium aluminide onto an article within a treatment region to form a titanium aluminide surface. The titanium aluminide surface includes a refined gamma/alpha2 structure and/or the titanium aluminide is cold sprayed from a solid feedstock of a pre-alloyed powder.

18 Claims, 2 Drawing Sheets

(51) Int. Cl.

| | |
|---|---|
| ***B22F 1/00*** | (2006.01) |
| ***C21D 7/06*** | (2006.01) |
| ***C21D 9/00*** | (2006.01) |
| ***C22C 21/00*** | (2006.01) |

(52) U.S. Cl.
CPC ..... *F01D 25/00* (2013.01); *F05D 2230/80* (2013.01)

(56) References Cited

U.S. PATENT DOCUMENTS

| | | | |
|---|---|---|---|
| 5,785,775 | A | 7/1998 | Smashey et al. |
| 5,873,703 | A | 2/1999 | Kelly et al. |
| 6,408,928 | B1 | 6/2002 | Heinrich et al. |
| 7,163,715 | B1 | 1/2007 | Kramer |
| 7,278,353 | B2 | 10/2007 | Langan et al. |
| 7,479,299 | B2 | 1/2009 | Raybould et al. |
| 7,658,148 | B2 | 2/2010 | Langan et al. |
| 2005/0011395 | A1 | 1/2005 | Langan et al. |
| 2005/0100756 | A1 | 5/2005 | Langan et al. |
| 2006/0045785 | A1 | 3/2006 | Hu et al. |
| 2006/0090593 | A1 | 5/2006 | Liu |
| 2006/0093736 | A1 | 5/2006 | Raybould et al. |
| 2007/0240603 | A1 | 10/2007 | Ko et al. |
| 2008/0038149 | A1 | 2/2008 | Langan et al. |
| 2008/0041921 | A1 | 2/2008 | Creehan et al. |
| 2008/0102220 | A1 | 5/2008 | Haynes et al. |
| 2008/0110746 | A1 | 5/2008 | Kardokus et al. |
| 2008/0145649 | A1 | 6/2008 | Mannem et al. |
| 2008/0173206 | A1 | 7/2008 | Langan et al. |
| 2008/0289958 | A1 | 11/2008 | Kardokus et al. |
| 2009/0283611 | A1 | 11/2009 | Varanasi et al. |
| 2010/0263195 | A1 | 10/2010 | Niccolls et al. |
| 2010/0263761 | A1 | 10/2010 | Niccols et al. |
| 2010/0266781 | A1 | 10/2010 | Kusinski et al. |
| 2010/0266788 | A1 | 10/2010 | Niccolls et al. |
| 2010/0266790 | A1 | 10/2010 | Kusinski et al. |
| 2010/0285207 | A1 | 11/2010 | Creehan et al. |
| 2011/0129379 | A1 | 6/2011 | Zanon et al. |

FOREIGN PATENT DOCUMENTS

| | | | |
|---|---|---|---|
| JP | 06-264203 | | 9/1994 |
| WO | 2005056879 | A1 | 6/2005 |
| WO | 2006050329 | A1 | 5/2006 |
| WO | 2007001441 | A2 | 1/2007 |
| WO | 2008060917 | A2 | 5/2008 |
| WO | 2008101065 | A1 | 8/2008 |
| WO | 2008134516 | A2 | 11/2008 |
| WO | 2010121143 | A2 | 10/2010 |

OTHER PUBLICATIONS

Lindemann, Janny, Cesar Buque, and Fritz Appel. "Effect of shot peening on fatigue performance of a lamellar titanium aluminide alloy." Acta Materialia54.4 (2006): 1155-1164.*

ASM International, Materials Park, Ohio, ASM Handbook vol. 2, Properties and Selection: Nonerrous Alloys and Special-Purpose Materials, "Ordered Intermetallics", Oct. 1990, pp. 913-942.*

DeMasi-Marcin, Jeanine T., and Dinesh K. Gupta. "Protective coatings in the gas turbine engine." Surface and Coatings Technology 68 (1994): 1-9.*

Schimansky, F. P., K. W. Liu, and R. Gerling. "Spray forming of gamma titanium aluminides." Intermetallics 7.11 (1999): 1275-1282.*

Goral, M., et al. "Si-modified aluminide coating deposited on TiAlNb alloy by slurry method." Journal of Achievements in Materials and Manufacturing Engineering 21.1 (2007): 75-78.*

K. W. Liu, Microstructure and Tensile Properties of Spray Formed Gamma Ti48.9at%Al, Scripta Materialia, vol. 40, No. 5, pp. 601-608, 1999, Acta Metallurgica Inc., USA.

* cited by examiner

TITANIUM ALUMINIDE APPLICATION PROCESS AND ARTICLE WITH TITANIUM ALUMINIDE SURFACE

CROSS REFERENCE TO RELATED APPLICATIONS

This application is a divisional of, and claims the benefit of, U.S. patent application Ser. No. 13/276,568, now U.S. Pat. No. 8,475,882, filed Oct. 19, 2011, entitled "Titanium Aluminide Application Process and Article with Titanium Aluminide Surface," the disclosures of which are incorporated by reference in its entirety.

FIELD OF THE INVENTION

The present invention is directed to articles and application processes for metal and metallic components and, more specifically, to titanium aluminide articles and application processes.

BACKGROUND OF THE INVENTION

Preparation and repair of metal or metallic components, such as turbine blades and turbine buckets, can be done through welding and/or brazing. Components having a titanium aluminide (TiAl) surface can be welded or brazed. However, the welding or brazing can adversely affect the microstructure and/or mechanical properties of the component. For example, welding or brazing can form a heat affected zone that results in debit of mechanical properties.

TiAl can offer benefits of high strength to weight ratio and good resistance to temperature oxidation. However, certain processing of TiAl can form microstructures that are undesirable. For example, heating and hot working of TiAl above temperatures of 1150° C. can result in a duplex structure including equiaxed grains and gamma/alpha2 lamellae within a polycrystalline lamellar structure of an article formed from melting and casting of the polycrystalline lamellar structure. This change in microstructure due to hot working is generally undesirable and the lack of refined gamma/alpha2 lamellae results in decreased strength and/or shorter fatigue life and creep life.

An article with a TiAl surface and a TiAl application process not suffering from one or more of the above drawbacks would be desirable in the art.

BRIEF DESCRIPTION OF THE INVENTION

In an exemplary embodiment, a titanium aluminide application process includes cold spraying titanium aluminide onto an article within a treatment region to form a titanium aluminide surface. The titanium aluminide surface includes a refined gamma/alpha2 structure.

In another exemplary embodiment, a titanium aluminide application process includes cold spraying titanium aluminide onto an article within a treatment region to form a titanium aluminide surface. The titanium aluminide cold sprayed is from a solid feedstock of a pre-alloyed powder.

In another exemplary embodiment, an article includes a titanium aluminide surface, the titanium aluminide surface including a refined gamma/alpha2 structure.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Figure 1:
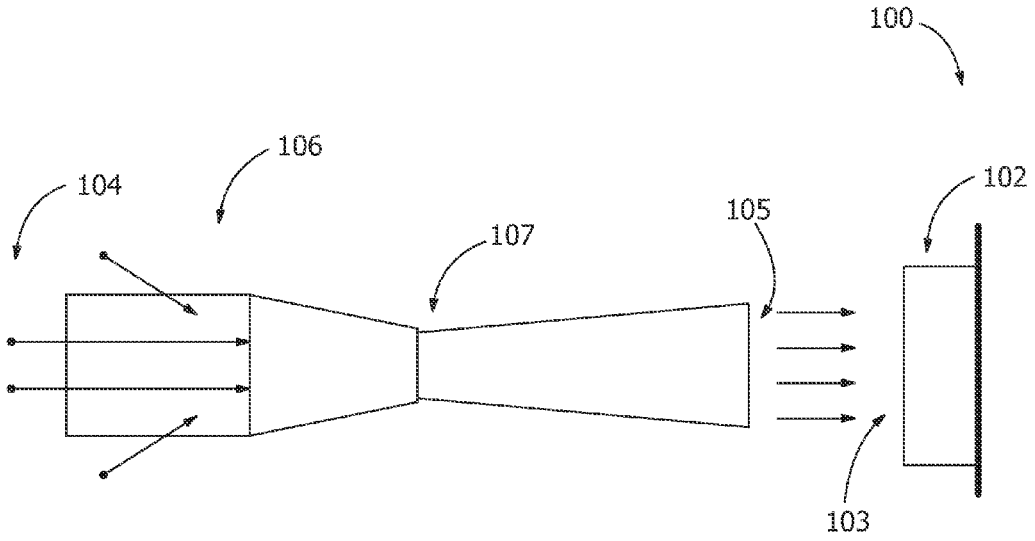
FIG. 1 is a schematic view of an exemplary article having a titanium aluminide surface cold sprayed onto it by an exemplary process according to the disclosure.

Provided is an exemplary article with a TiAl surface and an exemplary TiAl application process not suffering from one or more of the above drawbacks. Embodiments of the present disclosure include high strength-to-weight ratio and good resistance to high temperature oxidation based upon including TiAl, include a finer grain size, increase repair capabilities, permit simpler alloying of elements through using a powder/solid feedstock, permit alloying of the powder/solid feedstock during processing or upon deposition, reduce processing costs in comparison to more complex processes, include a reduced or eliminated heat affected zone, include a lamellar structure having refined gamma/alpha2 lamellae, include increased strength in comparison to having a duplex structure, include increased fatigue life and creep life in comparison to having a duplex structure, and combinations thereof FIG. 1 shows an exemplary article 100, such as a turbine blade, having a TiAl surface 102. The article 100 is any suitable metallic component. The article 100 is a compressor component, a turbine component, a turbine blade, a turbine bucket, or any other suitable metallic component commonly subjected to fatigue-type forces, such as low cycle fatigue. As used herein, the term "metallic" is intended to encompass metals, metallic alloys, composite metals, intermetallic materials, or any other suitable material including metal elements susceptible to fatigue-type forces.

The TiAl surface 102 includes any suitable titanium aluminide alloy composition. Suitable compositions include a stoichiometric composition (for example, having by weight about 45% Ti and about 50% Al and/or a Molar ratio of about 1 mole Ti to about 1 mole Al), $Al_2Ti$, $Al_3Ti$, or other suitable mixtures thereof. The TiAl surface 102 is a wear surface, a rotating surface, a sliding surface, another surface subject to fatigue-type forces, or a combination thereof. The TiAl surface 102 provides a higher strength-to-weight ratio and greater resistance to high temperature oxidation in comparison to welded, brazed titanium aluminide or spray-formed surfaces.

In one embodiment, the TiAl surface 102 includes a polycrystalline alloy having a refined gamma/alpha2 structure and/or little or no equiaxed grains. In one embodiment the TiAl surface 102 includes anisotropy providing greater strength in a direction perpendicular to the spray direction. In one embodiment, the TiAl surface 102 includes a fine grain size, for example, within a predetermined grain size range. Suitable grain size ranges include, but are not limited to, being between about 5 nanometers and about 100 microns, between about 5 nanometers and about 300 nanometers, between about 300 nanometers and about 100 microns, at about 5 nanometers, at about 300 nanometers, at about 100 microns, or any suitable combination or sub-combination thereof.

Figure 2:
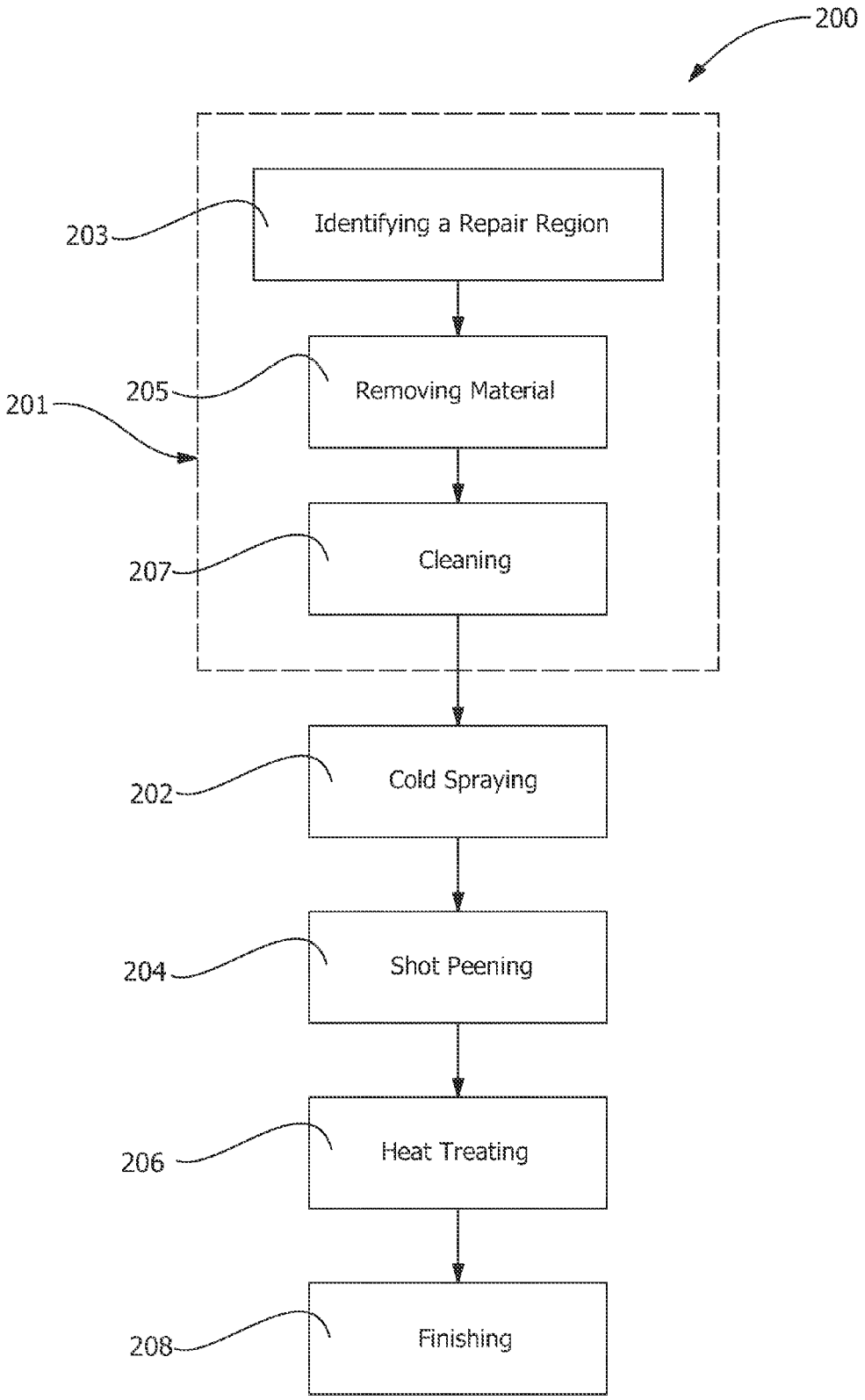
FIG. 2 is a flow diagram of an exemplary process of cold spraying titanium aluminide onto an exemplary article to form a titanium aluminide surface according to the disclosure.

Referring to FIG. 2, in an exemplary TiAl application process 200 capable of forming the article 100 having the TiAl surface 102, TiAl is applied by cold spray in an application process or a repair process. The TiAl application process 200 includes cold spraying TiAl (step 202) onto a treatment region 103 (see FIG. 1) of the article 100. The cold spraying of TiAl (step 202) uses a solid/powder feedstock 104 (see FIG. 1) and the processing takes places mostly in a solid condition with much less heat than processes such as welding or brazing or with negligible heat input from the solid feedstock 104. In one embodiment, the solid feedstock is a pre-alloyed powder and/or a mixture of two or more powders that alloy upon deposition.

The cold spraying of TiAl (step 202) forms the TiAl surface 102 by impacting the solid feedstock 104 particles in the absence of significant heat input to the solid feedstock. The cold spraying of TiAl (step 202) substantially retains the phases and microstructure of the solid feedstock 104. In one embodiment, the cold spraying of TiAl (step 202) is continued until the TiAl surface 102 is within a desired thickness range or slightly above the desired thickness range (to permit finishing), for example, between about 1 mil and about 200 mils, between about 1 mil and about 10 mils, between about 10 mils and about 20 mils, between about 20 mils and about 30 mils, between about 30 mils and about 40 mils, between about 40 mils and about 50 mils, between about 20 mils and about 40 mils, between about 50 mils and about 200 mils, or any suitable combination or sub-combination thereof.

In one embodiment, the cold spraying of TiAl (step 202) includes accelerating the solid feedstock 104 to at least a predetermined velocity or velocity range, for example, based upon the below equation for a converging-diverging nozzle 106 as is shown in FIG. 1:

$$\frac{A}{A^*} = \frac{1}{M}\left[\frac{2}{\gamma+1}\right]\left[1+\left(\frac{\gamma-1}{2}\right)M^2\right]^{\frac{\gamma+1}{2(\gamma-1)}} \quad \text{(Equation 1)}$$

In Equation 1, "A" is the area of nozzle exit 105 and "A*" is the area of nozzle throat 107. "γ" is the ratio $C_p/C_v$ of a process gas 109 being used ($C_p$ being the specific heat capacity at constant pressure and $C_v$ being the specific heat capacity at constant volume). The gas flow parameters depend upon the ratio of A/A*. When the nozzle 106 operates in a choked condition, the exit gas velocity Mach number (M) is identifiable by the equation. Gas having higher value for "γ" results in a higher Mach number.

The solid feedstock 104 impacts the treatment region 103 at the predetermined velocity or velocity range and the solid feedstock 104 bonds to the treatment region 103. The solid feedstock 104 has a fine grain size, for example, below about 100 microns, below about 10 microns, below about 5 microns, below about 4 microns, below about 3 microns, below about 10 nanometers, between about 3 and about 5 microns, between about 3 and about 4 microns, between about 4 and about 5 microns, between about 5 nanometers and about 10 nanometers, or any suitable combination or sub-combination thereof. In one embodiment, the solid feedstock is selected to increase ductility. The nozzle 106 is positioned a predetermined distance from the article 100, for example, between about 10 mm and about 100 mm, between about 10 mm and about 50 mm, between about 50 mm and about 100 mm, between about 10 mm and about 30 mm, between about 30 mm and about 70 mm, between about 70 mm and about 100 mm, or any suitable combination or sub-combination thereof.

In one embodiment, the treatment region 103 is directly on a substrate 101 of the article 100. The substrate 101 includes any suitable alloy. For example, in one embodiment, the substrate 101 includes a titanium-based alloy. In one embodiment, the substrate 101 is TiAl and/or the process is used for repair and/or fabrication of parts including the TiAl.

In one embodiment, the treatment region 103 is not directly on the substrate 101 of the article 100. For example, in a further embodiment, the treatment region 103 is on a bond coat (not shown). The bond coat is applied to the substrate 101 or one or more additional bond coats on the substrate 101, for example, by cold spray or thermal spray methods. In one embodiment, the bond coat is a ductile material, such as, for example, $Ti_6Al_4V$, Ni—Al, nickel-based alloys, aluminum, titanium, or other suitable materials. The bond coat is applied at a predetermined thickness, for example, between about 2 and about 15 mils, between about 3 and about 4 mils, between about 2 and about 3 mils, between about 2 and about 2.5 mils, between about 2.5 and about 3.0 mils, greater than about 1 mil, greater than about 2 mils, up to about 15 mils, or any suitable combination or sub-combination thereof In one embodiment, the bond coat is heat treated to promote diffusion into the substrate. In one embodiment, the bond coat provides an aluminide layer after diffusion. In one embodiment, the bond coat is formed by spraying more than one material in a powdered mixture, for example, aluminum and titanium.

Referring again to FIG. 2, in one embodiment, the TiAl application process 200 continues after the cold spraying of TiAl (step 202) with shot peening (step 204) of the TiAl surface 102. The shot peening (step 204) imparts residual compressive stresses, thereby increasing fatigue-resistance. In one embodiment, the shot peening (step 204) imparts energy to the article 100 that can aid in rapid diffusion and grain growth provided by a heat treatment.

In one embodiment, the TiAl application process 200 includes heat treating (step 206) the TiAl surface 102 and/or the article 100, for example, by placing the article 100 within a furnace under inert or reducing conditions. The heat treating (step 206) increases the depth of the diffusion bond. In one embodiment, the heat treating (step 206) is performed during the cold spraying of TiAl (step 202) by using heat provided at the spray site, for example, from a laser beam.

In one embodiment, the TiAl application process 200 includes finishing (step 208) the TiAl surface 102 and/or the article 100, for example, by grinding, machining, or otherwise processing.

In one embodiment, additional preliminary steps 201 are included in the TiAl application process 200. For example, in order to repair the TiAl surface 102 and/or the article 100 using the TiAl application process 200, in one embodiment, the TiAl application process 200 includes identifying a repair region (step 203). The repair region is identified by visual inspection, dye penetrant inspection, eddy current testing, or a combination thereof The repair region is any suitable portion of the article 100 or the TiAl surface 102, for example, a portion or all of the treatment region 103. Suitable portions include, but are not limited to, regions subjected to fatigue-type forces, regions subjected to forces that can cause cracks, regions that have exceeded their fatigue life or creep life, regions that include cracks, regions that include damage (for example, from impact of a foreign object), regions that include processing damage (for example, from machining errors), potentially damaged or actually damaged regions, or combinations thereof In one embodiment, the TiAl application further includes removing material (step 205) from the repair region. Removing material (step 205) permits further identification of the repair region and prepares the article 100 and/or the TiAl surface 102 to be repaired, for example, by opening up the repair region. In one embodiment, the removing of material (step 205) includes two separate sub-steps: a first sub-step of removal for identifying the repair region and a second sub-step for opening up the repair region.

After the removing of material (step 205), in one embodiment, the TiAl application process 200 includes cleaning (step 207) of the article 100 proximal to the repair region to prepare for the cold spraying of TiAl (step 202), for example, by degreasing. The cold spraying of TiAl (step 202) fills the repair region as described above.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine component, comprising a substrate and a titanium aluminide surface layer bonded to the substrate, the titanium aluminide surface layer of the turbine component including a gamma/alpha2 structure having a grain size of between about 5 nanometers and about 100 microns, wherein the titanium aluminide surface layer has a composition including at least one of $Al_2Ti$ and $Al_3Ti$.

2. The turbine component of claim 1, wherein the titanium aluminide surface layer has no equiaxed grains.

3. The turbine component of claim 1, wherein the titanium aluminide surface layer is devoid of duplex structure.

4. The turbine component of claim 1, wherein the titanium aluminide surface layer is devoid of polycrystalline lamellar structure.

5. The turbine component of claim 1, wherein the titanium aluminide surface layer has anisotropy.

6. The turbine component of claim 1, wherein the titanium aluminide surface layer is within a cold spray treatment region.

7. The turbine component of claim 1, wherein the titanium aluminide surface layer has a composition, by weight, including about 45% titanium and about 50% aluminum.

8. The turbine component of claim 1, wherein the titanium aluminide surface layer has a composition including $Al_2Ti$.

9. The turbine component of claim 1, wherein the titanium aluminide surface layer has a composition including $Al_3Ti$.

10. The turbine component of claim 1, wherein the titanium aluminide surface layer is directly bonded to the substrate.

11. The turbine component of claim 1, wherein the titanium aluminide surface layer is shot-peened.

12. The turbine component of claim 1, wherein the titanium aluminide surface layer is heat treated.

13. The turbine component of claim 1, wherein the titanium aluminide surface layer is finished.

14. The turbine component of claim 1, wherein the solid feedstock is a pre-alloyed powder.

15. The turbine component of claim 1, wherein the titanium aluminide surface layer has a grain size of between about 5 nanometers and about 300 nanometers.

16. The turbine component of claim 1, wherein the titanium aluminide surface layer has a thickness of between about 1 mil and about 200 mils.

17. A turbine component, comprising a substrate, a bond coat disposed on the substrate, and a titanium aluminide surface layer disposed on the bond coat and bonded to the substrate via the bond coat, the titanium aluminide surface layer of the turbine component including a gamma/alpha2 structure having a grain size of between about 5 nanometers and about 100 microns.

18. The turbine component of claim 17, wherein the titanium aluminide surface layer has no equiaxed grains.

* * * * *